US006513645B2

(12) United States Patent
Spatafora et al.

(10) Patent No.: US 6,513,645 B2
(45) Date of Patent: Feb. 4, 2003

(54) METHOD AND DEVICE FOR FEEDING ELONGATED ARTICLES ON A WRAPPING MACHINE

(75) Inventors: Mario Spatafora, Bologna (IT); Alberto Stagni, S. Pietro In Casale (IT)

(73) Assignee: G.D Societa per Azioni, Bologna (IT)

( * ) Notice: Subject to any disclaimer, the term of this patent is extended or adjusted under 35 U.S.C. 154(b) by 0 days.

(21) Appl. No.: 09/859,233

(22) Filed: May 16, 2001

(65) Prior Publication Data

US 2002/0011397 A1 Jan. 31, 2002

(30) Foreign Application Priority Data

May 18, 2000 (IT) ..... BO00A0298

(51) Int. Cl.[7] ..... B65G 47/12
(52) U.S. Cl. ..... 198/445; 198/436; 198/347.1
(58) Field of Search ..... 198/347.1, 347.4, 198/443, 445, 601, 580, 436, 452

(56) References Cited

U.S. PATENT DOCUMENTS

| | | | | |
|---|---|---|---|---|
| 2,833,393 A | * | 5/1958 | Kay | 198/445 |
| 3,472,358 A | * | 10/1969 | Poupin | 198/436 X |
| 4,231,461 A | * | 11/1980 | Hinchliffe et al. | 198/601 X |
| 6,318,540 B1 | * | 11/2001 | Spatafora | 198/347.1 X |

FOREIGN PATENT DOCUMENTS

| | | | | |
|---|---|---|---|---|
| FR | 1483632 | * | 6/1966 | 198/445 |
| SE | 308022 | * | 1/1969 | 198/445 |

* cited by examiner

*Primary Examiner*—James R. Bidwell
(74) *Attorney, Agent, or Firm*—Ladas & Parry

(57) ABSTRACT

A method and device for feeding elongated tobacco articles, whereby, on a wrapping machine, a mass of articles, oriented a given way, is fed along an annular path in a hopper connected to at least one channel for feeding the articles and in which the articles are fed in an orderly column.

15 Claims, 1 Drawing Sheet

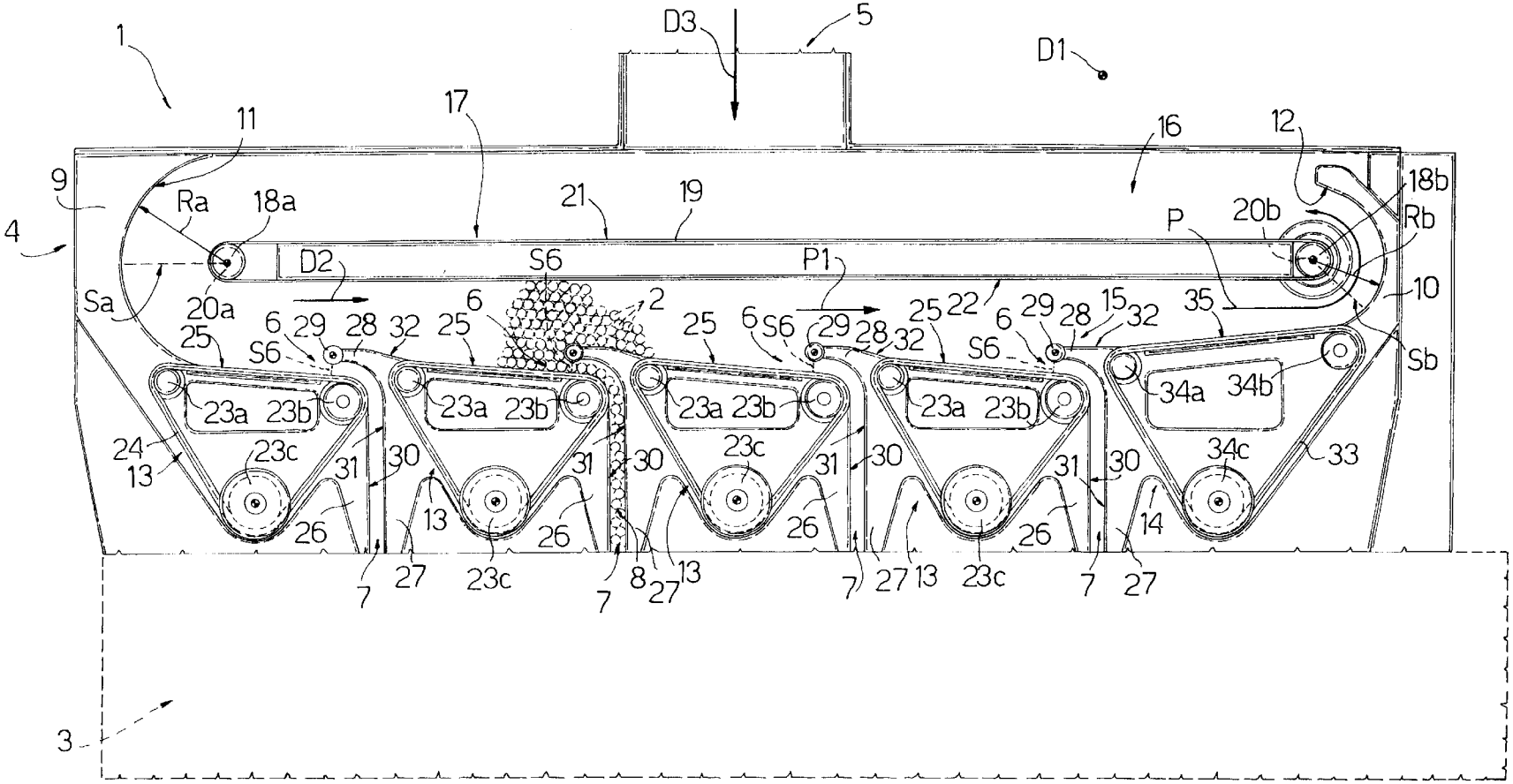
1
2
3
4
5
6
7
8
9
10
11
12
13
14
15
16
17
18a
18b
19
20a
20b
21
22
23a
23b
23c
24
25
26
27
28
29
30
31
32
33
34a
34b
34c
35
D1
D2
D3
P
P1
Ra
Rb
Sa
Sb
S6

METHOD AND DEVICE FOR FEEDING ELONGATED ARTICLES ON A WRAPPING MACHINE

The present invention relates to a method of feeding elongated articles on a wrapping machine.

The present invention is particularly advantageous for use in the tobacco industry, and specifically for feeding articles such as cigars, cigarettes or similar.

BACKGROUND OF THE INVENTION

In the following description, specific reference will be made purely by way of example to cigar wrapping machines.

Known cigar wrapping machines are equipped with a cigar feed device comprising a hopper with at least one channel underneath. The hopper has walls converging towards an outlet from which the channel extends, and houses a mass of cigars oriented a given way. Inside the hopper, the cigars drop by force of gravity towards the outlet and into the channel, along which they are arranged in an orderly column contacting one another, are guided by two opposite parallel walls of the channel, and travel under their own weight and the weight of the cigars inside the hopper.

Known feed devices have the drawback of the cigars possibly forming bridges, i.e. arc-shaped supporting structures defined by adjacent cigars resting on one another and on the walls of the hopper, and which clog the outlet, thus preventing the cigars from being fed into the channel, and preventing the cigars on top from exerting the weight force required to feed the cigars along the channel.

SUMMARY OF THE INVENTION

It is an object of the present invention to provide a method of feeding elongated articles on a wrapping machine, designed to eliminate the drawbacks of the known state of the art.

According to the present invention, there is provided a method of feeding elongated articles on a wrapping machine comprising a device in turn comprising a hopper for housing a mass of said articles oriented in a first direction, and at least one channel for feeding the articles and in which said articles are arranged in an orderly column; said channel being connected to an outlet of the hopper; and the method being characterized by comprising the step of feeding said mass of articles along an annular path inside said hopper; said outlet being located along said annular path.

The present invention also relates to a device for feeding elongated articles on a wrapping machine.

According to the present invention, there is provided a device for feeding elongated articles on a wrapping machine; the device comprising a hopper for housing a mass of said articles oriented in a first direction, and at least one channel for feeding the articles and in which said articles are arranged in an orderly column; said channel being connected to an outlet of the hopper; and the device being characterized by comprising conveying means housed inside said hopper to feed said mass of articles along an annular path inside said hopper; said outlet being located along said annular path.

BRIEF DESCRIPTION OF THE DRAWING

The present invention will be described with reference to the accompanying drawing showing a nonlimiting embodiment of the present invention. In particular, the accompanying drawing shows a partly sectioned front view, with parts removed for clarity, of a cigar feed device in accordance with the present invention.

DETAILED DESCRIPTION OF THE INVENTION

Number 1 in the accompanying drawing indicates as a whole a device for feeding cigars 2 on a wrapping machine 3 for wrapping each cigar 2 in a respective sheet of wrapping material not shown. Device 1 comprises a hopper 4, in turn comprising an inlet 5, four outlets 6, and four channels 7, each of which is connected to a respective outlet 6 and guides cigars 2, arranged in an orderly column 8, to machine 3. The cigars 2 inside hopper 4 and channels 7 are oriented in a direction D1 perpendicular to the plane of the accompanying drawing.

Hopper 4 comprises a front wall and a rear wall not shown in the accompanying drawing; two lateral guides 9 and 10 having respective curved guide surfaces 11 and 12; four conveyors 13 associated with respective channels 7; and a conveyor 14 for recirculating cigars 2. Conveyors 13 and 14 partly define a bottom wall 15 of hopper 4, which has a compartment 16 occupied partly by a conveyor 17 dividing compartment 16 into a top portion and a bottom portion connected to the top portion by lateral guides 9 and 10.

Conveyor 17 extends horizontally, and comprises a transmission pulley 18*a* located at guide 9; a drive pulley 18*b* located at guide 10; and a belt 19 looped about pulleys 18*a* and 18*b*. Pulleys 18*a* and 18*b* rotate about respective axes 20*a* and 20*b* parallel to direction D1, and conveyor 17 comprises a horizontal top branch 21 and a horizontal bottom branch 22 connected to each other at pulleys 18*a* and 18*b*. Conveyor 17 is rotated anticlockwise in the accompanying drawing to feed a mass of cigars 2 along an annular path P comprising a portion P1 extending in a horizontal direction D2 between bottom branch 22 and conveyors 13 and 14. Guide surface 11 is a portion of a cylinder of radius Ra and axis 20*a*, and forms with pulley 18*a* a constant passage section Sa. Similarly, guide surface 12 is a portion of a cylinder of radius Rb and axis 20*b*, and forms with pulley 18*b* a constant passage section Sb. Pulleys 18*a* and 18*b* are equal in diameter, whereas radius Ra is greater than radius Rb so that passage section Sa is greater than passage section Sb.

Each conveyor 13 comprises two transmission pulleys 23*a*, 23*b* and a drive pulley 23*c*, about which is looped a belt 24, and comprises a top branch 25 sloping slightly downwards from left to right in the accompanying drawing and with respect to direction D2. That is, each branch 25 slopes towards respective channel 7 to assist the downward flow of cigars 2 into channel 7.

Each channel 7 is defined by a vertical wall 26 tangent to pulley 23*b*, and by a wall 27 parallel to wall 26 and comprising an appendix 28, which extends about pulley 23*b*, is substantially parallel to a portion of branch 25, and is fitted on the free end with a revolving roller 29. Wall 26 comprises a vertical surface 30 connected to pulley 23*b*, and wall 27 comprises a surface 31 having a portion parallel to and facing surface 30, a portion extending about the axis of pulley 23*b*, and a portion parallel to a portion of branch 25. Appendix 28 has an upper face 32 on which the cigars 2 in hopper 4 rest, and therefore defines a portion of channel 7 and a portion of bottom wall 15 of hopper 4. Each outlet 6 of hopper 4 coincides with the inlet of a respective channel 7, extends between roller 29 and respective branch 25, and has a passage section S6 sized according to the diameter of cigars 2 so as to permit access to respective channel 7 by one cigar 2 at a time.

Each channel 7 is therefore connected to the hopper by outlet 6, and comprises, as of outlet 6, a straight sloping portion extending between appendix 28 and branch 25; a curved portion extending between appendix 28 and pulley 23*b;* and a straight vertical portion extending between walls 26 and 27. Passage section S6 is substantially perpendicular to direction D2 and path portion P1 to intercept part of the mass of cigars 2.

Recirculating conveyor 14 comprises a belt 33 looped about two transmission pulleys 34*a* and 34*b* and a drive pulley 34*c,* and comprises a branch 35 sloping upwards in direction D2. That is, branch 25 of the first conveyor 13, on the left in the accompanying drawing, connects guide surface 11 to respective channel 7; branch 35 of conveyor 14 connects face 32 of appendix 28 of the last channel 7, on the right in the accompanying drawing, to guide surface 12; and branches 25 of the central conveyors 13 connect the faces 32 of appendixes 28 of the respective upstream channels 7 to their own respective channels 7. The bottom wall 15 of hopper 4 is therefore defined partly by branches 25 and 35, and partly by appendixes 28, and each outlet 6 defines a step in bottom wall 15 for intercepting the cigars 2 traveling along path P.

In actual use, cigars 2 are bulk fed continuously or discontinuously in direction D3 into hopper 4 through inlet 5. Conveyor 17 is fed continuously anticlockwise in the accompanying drawing, while conveyors 13 and 14 are fed continuously clockwise. Top branch 21 of conveyor 17 feeds cigars 2 through passage section Sa and between the bottom branch 22 of conveyor 17 and branch 25 of the first conveyor 13 in direction D2. The combined action of conveyor 17 and conveyor 13 feeds cigars 2 in bulk in direction D2, while the cigars 2 traveling in contact with branch 25 are intercepted by outlet 6 and fed through passage section S6 into respective channel 7. In the same way, each conveyor 13 supplies respective outlet 6 and feeds cigars 2 along the respective channel 7; and conveyor 14 cooperates with conveyor 17 to feed some of cigars 2 through passage section Sb and back onto top branch 21 of conveyor 17.

Force feeding cigars 2 in bulk along path P prevents the formation of bridges and at the same time provides for feeding cigars 2 onto branches 25 leading into respective channels 7, thus preventing any interruption in supply; while recirculating conveyor 14 provides for sending back into circulation along path P any cigars 2 failing to engage any channel 7 along portion P1 of the annular path.

The number of channels 7 is a design parameter of machine 3, may range from one to a very high number, and obviously determines the number of outlets 6 and conveyors 13.

What is claimed is:

1. A method of feeding elongated articles on a wrapping machine having a hopper (4) for housing a mass of said articles (2) oriented in a first direction (D1), and a number of channels (7) for extracting the articles (2) from the hopper (4) and in which said articles (2) are arranged in an orderly column (8); the hopper (4) having an inlet (5) and an outlet (6), which is connected to the channels (7), and powered conveying means (13, 14, 17) for moving the mass of articles (2) inside the hopper (4) along an annular path (P) having a conveying branch extending from the inlet (5) to the outlet (6) and a recirculation branch extending from the outlet (6) to the inlet (5); the method comprising the steps of:

feeding the mass of articles (2) through said inlet (5) inside the hopper (4), moving the mass of articles (2) inside the hopper (4) along said conveying branch of said annular path (P) from the inlet (5) to the outlet (6) so as to convey at least part of the articles (2) through the channels (7), and moving a remaining mass of articles (2) not conveyed through the channels (7) along the recirculating branch of the annular path (P) from the outlet (6) to the inlet (5) so as to recirculate said remaining mass of articles (2).

2. A method as claimed in claim 1, comprising intercepting said articles conveyed along said path in said outlet (6) which is located along a portion (P1) of said annular (P), and feeding said articles from said outlet to a passage (S6) extending substantially perpendicular to said portion (P1).

3. A method as claimed in claim 1, comprising arranging a plurality of said outlets (6) in succession along said portion (P1) of said annular path to receive one said article at a time.

4. A method as claimed in claim 3, comprising arranging each said outlet as a step on said conveying branch to receive one said article at a time.

5. A method as claimed in claim 4, comprising inclining said conveying path downwardly towards each said outlet and inclining said conveying path upwardly along said recirculating branch.

6. A device for feeding elongated articles (2) on a wrapping machine (3); said apparatus comprising a hopper (4) for housing a mass of said articles (2) oriented in a first direction (D1), and a number of channels (7) for extracting the articles (2) from the hopper (4) in an orderly column (8); said hopper (4) having an inlet (5) and an outlet (6), which is connected to the channels (7), and powered conveying means (13, 14, 17) for moving the mass of articles (2) inside the hopper (4) along an annular path (P) having a conveying branch extending from the inlet (5) to the outlet (6) and a recirculating branch extending from the outlet (6) to the inlet (5); said powered conveying means (13, 14, 17) comprising first conveying means (13, 17) for moving the mass of articles (2) inside the hopper (4) along said conveying branch from the inlet (5) to the outlet (6) so as to convey at least part of the articles (2) through the channels (7), and second conveying means (14, 17) for moving a remaining mass of articles (2) not conveyed through the channels (7) along said recirculating branch of the annular path (P) from the outlet (6) to the inlet (5) so as to recirculate said remaining mass of articles (2).

7. A device as claimed in claim 6, wherein said outlet (6) is located along a portion (P1) of said annular path (P), and comprises a passage section (S6) extending substantially perpendicular to said portion (P1) to intercept said articles (2) fed along said portion.

8. A device as claimed in claim 6, wherein said conveying means (13, 14, 17) comprises a number of first conveyors (13), each of which is located at a respective said outlet (6) and comprises a branch (25) adjacent to said respective outlet (6) for feeding said articles (2) to said respective outlet (6).

9. A device as claimed in claim 8, wherein each said branch (25) defines a portion of a respective channel (7).

10. A device as claimed in claim 8, wherein said powered conveying means comprises a second conveyor (17) having a top branch (21), and a bottom branch (22) facing the branches (25) of said first conveyors and cooperating with said branches (25) of said first conveyor to feed said mass of articles (2) along said portion (P1) of said annular path (P).

11. A device as claimed in claim 8, wherein each of said first conveyors has an upper branch inclined downwardly towards its respective said outlet.

12. A device as claimed in claim 10, wherein said second conveying means comprises a third conveyor (14) having a branch (35) facing said bottom branch (22); said branch (35) of the third conveyor cooperating with said bottom branch (22) to transfer said mass of articles (2) onto said top branch (21).

13. A device as claimed in claim 10, wherein said branch (35) of said third conveyor (14) is inclined upwardly along said recirculating branch.

14. A device as claimed in claim 7, wherein a plurality of said outlets are arranged in succession along said portion (P1) of said annular path and are connected respectively to said channels.

15. A device as claimed in claim 14, wherein said outlets have respective said passage sections disposed as open steps on said conveying branch to intercept one said article at a time from said mass.

* * * * *